US005727684A

United States Patent [19]

Webb et al.

[11] Patent Number: 5,727,684

[45] Date of Patent: Mar. 17, 1998

[54] METHOD OF DETECTING HEAT SEAL BREAKS AND PACKAGE THEREOF

[75] Inventors: Nicholas J. Webb, Wrightwood, Calif.; Hiro Hayashi, White Plains, N.Y.

[73] Assignee: Mitsui Plastics Company, White Plains, N.Y.

[21] Appl. No.: 704,243

[22] Filed: Aug. 28, 1996

[51] Int. Cl.[6] ..... B65D 85/00; G01N 19/08

[52] U.S. Cl. ..... 206/439; 206/484.1; 206/459.1; 206/807; 73/49.8; 436/1

[58] Field of Search ..... 206/438, 439, 206/807, 363, 484, 484.1, 459.1, 459.5; 73/49.3, 49.8; 436/1, 3; 422/119

[56] References Cited

U.S. PATENT DOCUMENTS

| | | | |
|---|---|---|---|
| 3,533,548 | 10/1970 | Taterka . | |
| 3,616,898 | 11/1971 | Massie | 206/459.1 |
| 3,991,881 | 11/1976 | Augurt | 206/439 |
| 4,097,236 | 6/1978 | Daly et al. . | |
| 4,098,577 | 7/1978 | Halpern . | |
| 4,121,714 | 10/1978 | Daly et al. | 206/459.1 |
| 4,194,622 | 3/1980 | Lewis . | |
| 4,197,947 | 4/1980 | Zaidi . | |
| 4,206,844 | 6/1980 | Thukamoto et al. | 206/459.1 |
| 4,235,332 | 11/1980 | Anderson et al. . | |
| 4,285,105 | 8/1981 | Kirkpatrick . | |
| 4,709,397 | 11/1987 | Voshall et al. | 206/459.1 |
| 4,760,919 | 8/1988 | Pereyra . | |
| 5,064,664 | 11/1991 | Hustad | 206/459.1 |
| 5,328,661 | 7/1994 | Taschner | 206/459.1 |
| 5,492,411 | 2/1996 | May . | |

*Primary Examiner*—Jacob K. Ackun
*Assistant Examiner*—Luan K. Bui
*Attorney, Agent, or Firm*—Longacre & White

[57] ABSTRACT

An apparatus and associated method which detects breaks and irregularities in a sealing arrangement, especially in heat-sealed, sterile packages by providing a standardized verification bar on the package adjacent a color coded sealing area. The verification bar may indicate examples of a proper seal, an underseal, and an overseal, as well as common seal problems such as bubbles, hairline voids and regular coextensive voids. The package which is especially useful as a sterilization pouch can be visually inspected both by the user of the package contents just prior to use and by the vendor of articles in the packages post assembly of the article into the sealed and sterilized package.

14 Claims, 1 Drawing Sheet

METHOD OF DETECTING HEAT SEAL BREAKS AND PACKAGE THEREOF

BACKGROUND OF THE INVENTION

1. Field of the Invention

This invention relates to an apparatus and associated method which detects breaks and irregularities in a sealing arrangement, especially in heat-sealed, sterile packages.

2. Description of Related Art

Sterilizable packages or pouches made by heat sealing a clear plastic laminate to surgical grade kraft paper or the like have come into widespread use, particularly in the medical industry. The paper portion of such packages is designed to be sufficiently porous to permit gas or steam sterilization but is impervious to bacteria. The plastic laminate is heat sealable to the paper, stable under sterilization conditions, impervious to bacteria and permits visual identification of the package contents. Indicator inks that change color upon sterilization (gas or steam) are typically printed on the exterior, paper side of the package.

Such packages are used for medical implements that must be sterile prior to use. Typically, the manufacturer or user (such as a hospital or clinic) of such medical implements is supplied with a package heat sealed around three sides by the package manufacturer. The medical implement is then placed in the package and the fourth side is heat sealed to complete the marginal seal between the paper and the plastic.

After sterilization, either by exposure to ethylene oxide gas or by steam autoclaving, by the medical implement manufacturer or by the hospital or clinic, the package and its sterile contents can be stored for extended periods of time in a sterile condition.

Prior to use, for example in an operating room, the marginal heat seal of the package is visually inspected in an effort to detect whether or not the initial heat seal is adequate or whether or not there are any subsequent breaks or ruptures in the heat seal, for example by accidental tampering with the package after sterilization or by shifting of the package contents in such a way that the heat seal becomes broken or ruptured.

Sterilization pouches are conventionally made of clear, colorless plastic film heat sealed to white paper. This combination of materials makes it extremely difficult, if not impossible, to visually determine if the initial seal has subsequently been ruptured or broken by tampering or movement of the package contents.

To more readily ascertain the validity of the initial heat seal, it has been proposed to lightly tint the plastic laminate member or to coat the paper member with a lightly tinted heat seal coating.

U.S. Pat. No. 4,097,236 to Daly et al. disclose a method for detecting a break or rupture in a heat seal between a paper member and a clear plastic member by providing a paper member with a relatively dark coloration, at least in the area of the heat seal. The clear plastic member is heat sealed to the paper member in the desired seal area whereby, upon breaking of the heat seal, there is a distinct color contrast between the break in the heat seal and the relatively dark coloration of the underlying paper and any remaining heat sealed area.

These prior approaches, however, have been far from satisfactory in that it is not possible to readily ascertain by visual inspection the adequacy and completeness of the heat seal between the plastic film and the paper member.

Moreover, the prior art arrangements fail to provide a standardized color strip adjacent the heat seal for ascertaining the quality of the sealing arrangement for each package as compared to desired or acceptable sealing arrangements.

SUMMARY OF THE INVENTION

The present invention provides a method and a package, especially for sterilization pouches, which overcomes the problems heretofore encountered in a simple, effective and reliable fashion.

The invention facilitates detection of a break or rupture in a heat sealed package by providing a color bar standard on the package adjacent a color coded sealing area. The color bar standard may indicate examples of a proper seal, an underseal, and an overseal, as well as common seal problems such as bubbles, hairline voids and regular coextensive voids.

The invention therefore provides a package which is especially useful as a sterilization pouch wherein breaks or ruptures in the heat seal due to either tampering with the package or movement of the package contents can be readily detected visually by the user of the package contents just prior to use.

BRIEF DESCRIPTION OF THE DRAWINGS

The present invention will be more fully understood from the following description taken in conjunction with the accompanying drawings wherein.

DETAILED DESCRIPTION OF PREFERRED EMBODIMENT

Figure 1:
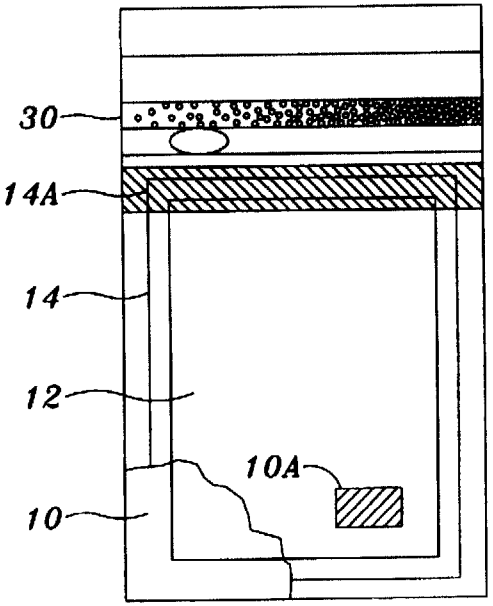
FIG. 1 is a top plan view of a sterilization package according to the invention having a heat sealed around the periphery or sides of the package and a color bar standard along its top edge.

The preferred embodiment of a sterilization pouch 1 of FIG. 1 is shown to include a paper substrate member 10 and a clear plastic or similar laminate 12 which is heat sealed around the sides of the package to complete the heat seal 14.

The paper member 10 can be conveniently dyed or tinted a desired color, for example blue, green, red, brown, grey, or black. In the alternative, instead of dyeing or tinting the paper member 10, the paper member can have a relatively dark coating applied thereto, at least in the heat seal area. This can readily be accomplished by overprinting all or only the seal area of the paper member 10 with a dark ink such as the colors previously mentioned. The dye, tint or ink should be selected so as to be stable under sterilization conditions.

Readily available surgical grade kraft paper having the desired porosity characteristics can be readily dyed or overprinted to provide the desired relatively dark coloration for the paper member 10.

The term "paper" as used herein also applies to synthetic or artificial paper materials made from plastic fibers and the like, as well as conventional paper products having the necessary characteristics for use in sterilization pouches. An example of synthetic paper is a spun bonded polyethylene sold by DuPont under the trademark "TYVEK".

The plastic member 12 is preferably a laminate of a polyester, such as polyethylene terephthalate sold under the trademark "MYLAR", and a heat sealable thermoplastic material such as polyethylene, polypropylene, ethylene vinyl acetate, an ionomer such as DuPont's "SURLYN", copolymers and mixtures of the foregoing. The polyester layer forms the exterior of the package and the heat sealable thermoplastic material interfaces with the paper member 10 and forms the marginal heat seal 14.

Heat sealing the plastic member 12 to the paper member 10 around the margin of the package as shown in FIG. 1 of the drawing can be accomplished using conventional heat sealing equipment and techniques. Generally, the heat seal is made wide enough to guarantee an adequate and complete seal around the margin of the package initially formed with a heat seal around the sides of the package.

Indicator inks that change color upon sterilization, either gas or steam autoclaving, can be printed on either side of the paper portion of the package (see indicia 10*a* of FIG. 1). These indicator inks are readily available in a variety of colors and should be chosen so as to be visually detectable against the paper background, both before and after sterilization.

According to the invention, the sealing area 14*a* exhibits a variety of appearances depending on the quality of the seal resulting from each sealing operation. The variety of seal appearances results from the chemical reaction taking place during the heat sealing operation. It is noted, of course, that certain defects come into being only after the heat seat is ruptured or broken.

As described above, the paper member 10 and plastic member 12 interact during the sealing process to illuminate a color indicative of the seal integrity. With the sealing design of this invention, the color of the seal may be chosen to vary along a continuum from a light color, which for example may be indicative of an underseal, to a dark color, which may be indicative of an overseal. In order to visually detect the quality of each sealing operation, a color standard 20 is provided for seal verification.

Figure 3:
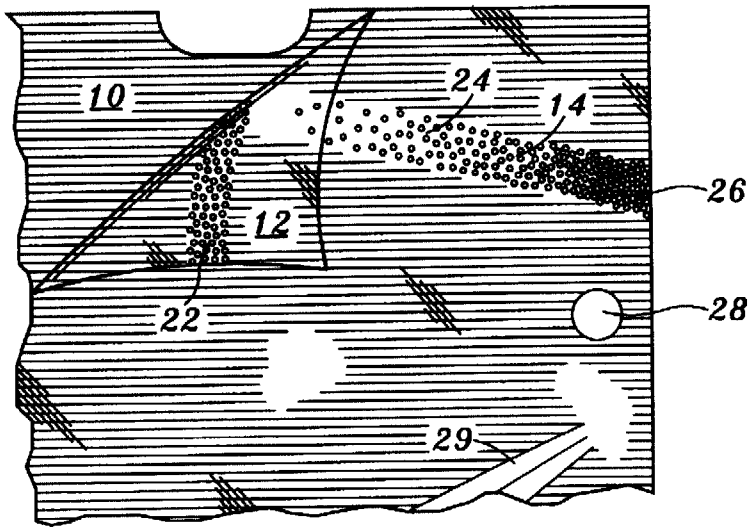
FIG. 3 is a top plan view partly broken away of a sterilization pouch according to the invention illustrating various ways in which breaks or ruptures in a heat seal can occur.

FIG. 3 illustrates how the present invention provides a visual contrast for readily detecting breaks or ruptures in the heat seal between the paper member 10 and the plastic member 12, whether due to partial opening of the package, either intentionally or unintentionally, or by shifting of the package contents. In FIG. 3 the plastic member 12 is shown pulled back and separated from a chevron portion of the heat seal area 14. FIG. 3 shows the tinted appearance 22 from the heat seal side of the plastic member 12, whereas the lightly colored portion 24 and the darkly colored portion 26 shows the contrast that results on the exterior side of the plastic film 12 from a undersealed portion (lightly colored portion 24) and an oversealed portion (darkly colored portion 26). Note especially the marked contrast of the broken heat seal area, exemplified by bubble 28 and void 29 with respect to the dark coloration of the paper member 10 itself and the remaining sealed area 14. It should also be noted that the sealed area 14 has a glossy, clear appearance which is in contrast to the dull or matte finish appearance of the paper member 10 through the plastic member 12 outside of the seal area 14. This contrast can be used to detect voids or defects in the heat seals made by the package manufacturer and also the packager.

Figure 2:
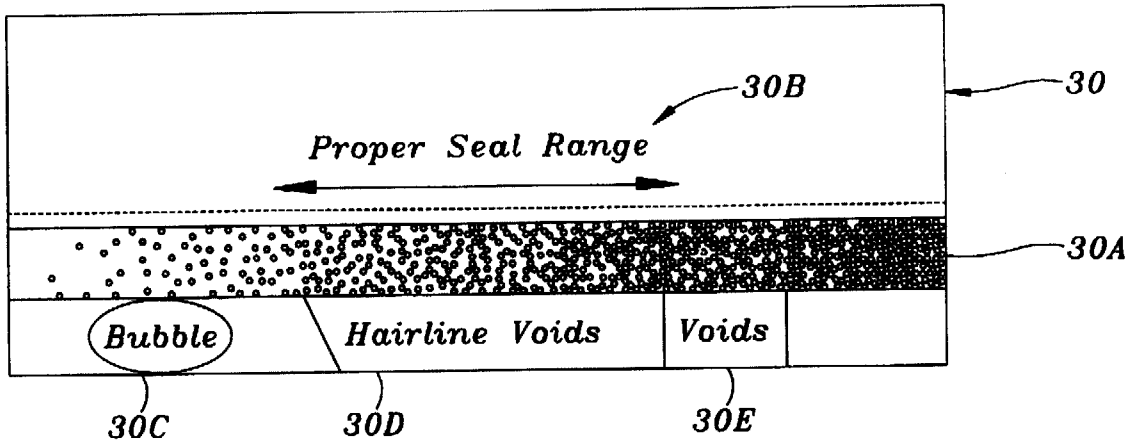
FIG. 2 is an enlarged view of the color bar standard of FIG. 1 as set forth by this invention.

As illustrated in FIG. 2 the color bar standard 30 is provided in the form of a strip on the package preferably adjacent to a lengthwise portion of the sealed area (see FIG. 1). The color bar standard 30 may comprise a color continuum 30*a* that varies from light to dark of the particular color embodied by the seal arrangement. In the preferred embodiment, the standardized color bar 30 further defines the proper seal range 30*b* marking the acceptable color range for adequate sealing. Moreover, the color bar standard 30 may provide examples of various defects that may occur in the seal, i.e. bubbles 30*c* and voids 30*d*, 30*e*.

In the preferred embodiment, the color bar standard 30 is printed directly on the package; however, it is also possible to affix a separate color bar standard to the package. In this modified embodiment, the color bar standard 30 may take the form of a continuous adhesive strip that is rolled onto consecutive packages during mass production. In addition, the color bar standard may be formed as a pressure sensitive label that is affix to the package.

As evident from the foregoing description, the present invention provides an improved seal verification system and method, wherein a standardized color bar 30 is printed on or otherwise affixed to the package having elongated seal area circumscribing the contents of the package. The seal area 14*a* seal may be designed to change color during the sealing process with the resulting coloration being indicative of the seal integrity.

It will be understood by those having skill in the art that various changes in form and detail may be made in the system and method of this invention without departing from the spirit and scope of this invention.

What is claimed is:

1. A sterilizable package comprising:

a substrate member defining a containing area for supporting a sterilized article;

a plastic member affixed directly to said substrate member and overlying and surrounding said containing area along a heat seal formed during a heat sealing process, said plastic member being sufficiently porous to permit gas or steam sterilization but impervious to bacteria, wherein said heat seal has a color determined by a temperature and pressure applied during said heat sealing process; and a standardized verification means for verifying an integrity of said heat seal, said verification means being provided on at least one of said substrate and said plastic member adjacent and separate from said heat seal, wherein said standardized verification means displays a plurality of sealing characteristics indicative of correct and defective heat seals resulting from said heat sealing process in order that a user may compare said heat seal with the verification means to judge quality and integrity of said heat seal.

2. A sterilizable package according to claim 1, wherein said verification means comprises a color continuum indicative of a range of color changes indicative of said sealing characteristics.

3. A sterilizable package according to claim 1, wherein said verification means displays examples of improper sealing arrangements.

4. A sterilizable package according to claim 1, wherein said substrate member bears indicia that changes color upon sterilization.

5. A sterilizable package according to claim 1, wherein said substrate member comprises color coded sealing area defining a condition of said heat seal.

6. A sterilizable package according to claim 1, wherein the substrate member is paper.

7. A sterilizable package according to claim 1, wherein the substrate member is surgical grade kraft paper.

8. A sterilizable package according to claim 1, wherein the plastic member is a laminate of a polyester and a heat sealable thermoplastic material.

9. A sterilizable package comprising:

surgical grade kraft paper which is sufficiently porous to permit gas or steam sterilization but is impervious to bacteria;

a clear plastic laminate of a polyester and a heat sealable thermoplastic marginally heat sealed to one side of said paper and defining a containment pouch, wherein the integrity of the heat seal is indicated by a colored sealing area whose color is determined by a temperature and pressure applied during a heat sealing process; and verification means for displaying a plurality of sealing characteristics indicative of various heat seal qualities resulting from said heat sealing process, said verification means being provided on at least one of said paper and said plastic laminate adjacent and separate from said heat seal in order that a user may compare said heat seal with the verification means to judge quality and integrity of said heat seal.

10. A sterilizable package according to claim 9, wherein said verification means comprises a color continuum indicative of said heat seal qualities.

11. A sterilizable package according to claim 9, wherein said verification means comprises examples of improper sealing arrangement.

12. A sterilizable package according to claim 9, wherein said paper member bears indicia that changes color upon sterilization.

13. A sterilizable package according to claim 9, wherein said paper member comprises an indicator ink that changes color upon sterilization.

14. A method of detecting a break in a heat seal between a paper member and a clear plastic member which at least in part define a sterilizable package, said method comprising the steps of:

providing a dyed paper member which is sufficiently porous to permit gas or steam sterilization but which is impervious to bacteria;

heat sealing said clear plastic member directly to said paper member in a desired heat seal area to define said sterilizable package including a pouch delimited by a heat seal so created; wherein said heat seal area has a color determined by said heat sealing step; and visually examining said heat seal against a standardized seal verification means that displays a plurality of sealing characteristics indicative of correct and defective heat seals resulting from said heat sealing step provided adjacent and separate from said heat seal to detect improper sealing characteristics displayed on said standardized seal verification means.

* * * * *